United States Patent [19]

Grohe

[11] 4,141,502

[45] Feb. 27, 1979

[54] PULSATING WATER JET MASSAGE SHOWER HEAD CONSTRUCTION

[75] Inventor: Klaus Grohe, Schiltach, Schw., Fed. Rep. of Germany

[73] Assignee: Hans Grohe KG., Fed. Rep. of Germany

[21] Appl. No.: 770,011

[22] Filed: Feb. 18, 1977

[30] Foreign Application Priority Data

Feb. 18, 1976 [DE] Fed. Rep. of Germany ..... 2606321

[51] Int. Cl.[2] ..... B05B 1/08

[52] U.S. Cl. ..... 239/381; 239/558

[58] Field of Search ..... 239/101, 102, 380–383, 239/558, 562, 563

[56] References Cited

U.S. PATENT DOCUMENTS

| | | | |
|---|---|---|---|
| 1,752,633 | 4/1930 | Crane | 239/558 X |
| 2,878,066 | 3/1959 | Erwin | 239/383 |
| 3,762,648 | 10/1973 | Deines et al. | 239/383 |
| 3,801,019 | 4/1974 | Trenary et al. | 239/383 |
| 3,998,390 | 12/1976 | Peterson et al. | 239/102 X |
| 4,068,801 | 1/1978 | Leutheuser | 239/102 |

*Primary Examiner*—Robert W. Saifer
*Attorney, Agent, or Firm*—McGlew and Tuttle

[57] ABSTRACT

A pulsating water jet massage shower head comprises a shower head housing which has an interior chamber which opens outwardly. A nozzle member comprising a flat plate nozzle portion in a cylindrical fitted portion is fitted into the chamber of the housing and it is provided with a plurality of nozzle bores which extend through hollow cylindrical pin portions which extend upwardly from the interior surface of the plate portion. A cover member is arranged in the housing chamber spaced inwardly from the nozzle member and it has a segmental closing disk portion which acts to deflect water which is delivered through connecting conduits in the housing so as to cause rotation of a valve rotor positioned between the cover member and the nozzle member. The deflection and the rotation of the valve rotor produce rotating water jets through the nozzle bores. The valve rotor is mounted so that it floats between the cover member and the nozzle member and a pressure chamber is defined between the bottom of the nozzle plate and the valve member.

18 Claims, 12 Drawing Figures

PULSATING WATER JET MASSAGE SHOWER HEAD CONSTRUCTION

BACKGROUND OF THE INVENTION

1. Field of the Invention

The present invention relates in general to shower head constructions and in particular to a new and useful massage shower head comprising a mechanism for producing pulsating water jets by means of a valve rotor which is mounted for free rotation and axial play directly adjacent a nozzle plate having a plurality of jet forming nozzle bores, and which is provided with radial wall elements and with a segmental closing disk, and, at the upstream side of which, water guiding elements are provided which produce a rotary water motion in the space accommodating the rotor.

2. Description of the Prior Art

In a known nozzle head of this kind (German Auslegeschrift No. 1 027 364) which is intended particularly for underwater passage, the segment-shaped closing disks of the valve rotor are disposed closely adjacent the inside surface of the nozzle plate in which the water outlets are provided. In other shower heads of the prior art (German Offenlegunsschrift Nos. 2,329,258 and 2,342,612, and U.S. Pat. Nos. 2,878,006; 3,762,648; and 3,801,019), the valve members of the valve rotors are also designed as flat disks of circular-sector or ring-segment shape which are disposed closely adjacent the inside plane surface of the nozzle plate having paraxial nozzle bores, and provided with substantially radially extending wings or wall elements acting as turbine blades. In all these known valve rotors provided with sectorial or ring-segment disks, regardless of the various, always multiple, inlet channels which are directed against the rotor wings obliquely radially or obliquely axially, considerable bearing friction is produced due to the water pressure acting in axial direction on the closing disks of the valve rotors. While the closing disks having a diagonally symmetrical surface distribution, this friction problem may be solved in a fairly satisfactory manner with corresponding expenses, for example, by providing a low-friction point or pivot support for the valve rotor, with closing disks having a diagonally unsymmetrical surface distribution, such as provided in a design of the prior art (German Offenlengungsschrift No. 2,329,258). For reducing the friction forces which produce a strong braking effect, special sliding disks are needed in addition to combined ball and journal bearings. Irrespective of the additional costs connected thereto, this cannot ensure a rotation of the valve rotor under any circumstances, particularly such as a lower water pressure, because of the large contact area between the inside of the nozzle plate and the closing surface of the closing or slide disk and the adhesion or static friction forces thereby produced. Such disturbances in function may be expected also with another known design (U.S. Pat. No. 3,801,019) where the valve rotor comprises a closing member in the form of a ring segment extending through about 180° and placed directly, without any guidance, in flat contact with the plane inside surface of the nozzle plate.

It is further known to reduce the "sharpness" of the jet pulses by providing a larger distance between the closing disk and the inside surface of the nozzle plate (U.S. Pat. No. 2,878,066, Col. 4). For this purpose, the valve rotor of the prior art is provided with an axially adjustable conical bearing permitting, in addition, the compensation of any wear of the support.

SUMMARY OF THE INVENTION

The present invention is directed to a massage shower head in which the bearing friction of the valve rotor is minimized and the "sharpness" of the pulsating water jets, which, as is well known, depends also on the actual hydraulic pressure or on the rate of flow, is more pronounced than in the massage shower heads of the prior art. This objective is achieved with a minimum of costs and a space-saving, rugged construction.

In accordance with the invention, a pressure cavity is provided between the plane of rotation of the closing disk of the valve rotor and the nozzle plate. The cavity is open toward the closing disk and has a radius which is equal, at least approximately, to that of the closing disk. It is further provided that the nozzle plate is formed with hollow pins or bore field segments through which the nozzle bores extend and which project into the pressure cavity at least approximately up to the plane of rotation of the closing disk.

During operation of the shower head, a water cushion forms in this pressure cavity, by which the pressure acting on the closing disk in the axial flow direction is compensated, so that the entire valve rotor, to which the closing disk is rigidly secured, occupies an axially floating position, i.e. has an axial play, as mentioned above. The negligibly small bearing friction thereby obtained not only leads to an optimum speed of the valve rotor and, consequently, to an optimum pulse frequency, but also results, as has been proved by extensive tests, in a distinctly improved pulse sharpness and, thereby, in a considerable improvement of the massage effect.

According to a development of the invention, the valve rotor is guided, by means of a hub, on a journal pin which centrally projects from the nozzle plate and i s provided with an annular shoulder. This ensures that the valve rotor does not come into contact with the surrounding wall, which would result in strong braking of its rotation, and that the closing disk also cannot come into contact with the hollow pins projecting into the pressure cavity. It has been found advantageous to provide a gap of 0.1 to 0.2 mm between the closing disk and the hollow pins.

An optimum design of the valve rotor, both as to its function and its manufacture, particularly injection molding, is obtained if the rotor comprises a total of three wall elements which are equidistantly angularly spaced from each other, and a ring wall surrounding the wall elements and having approximately the same axial length, and, if the closing disk is a sector extending through two angular fields of the wall elements. With a correspondingly thin-walled construction, which, as is well known, is always desired in injection molding, the advantage is obtained that the total weight and the mass moment of inertia of the rotor are very small. The ring wall provides the valve rotor with a high inherent stability and ensures an equilibrium of the pressure forces acting in the radial direction, which also contributes to a reduced radial bearing friction.

Another difference relative to the massage shower heads of the prior art is in accordance with a further development of the invention, that upstream if the valve rotor and axially spaced therefrom, there is an annular channel which extends concentrically of a cylindrical pin coaxial of the axis of rotation of the rotor, and is partly covered in the entrance zone of a axial or tangential supply channel, and the bottom of which extends partly obliquely to the axis of symmetry, toward the plane of rotation of the valve rotor.

While in the types of massage shower heads of the prior art, separate disk-shaped or cylindrical parts having a plurality of obliquely axially or obliquely radially extending water conveying bores are necessary for the rotary drive of the valve rotor, the manufacture of which is, at least partly, very expensive, the inventive annular channel can be formed directly in the shower head, with the additional advantage that its geometry is very simple and convenient for manufacture. Also, this annular channel does not require any additional space, so that a small overall length in axial direction can be obtained. Moreover, it has been found that the flow noises produced in the annular channel are substantially less intense than those produced in the known, always multiple, nozzle-like conveying channels.

For obtaining an optimum drive effect for the valve rotor, it is advisable to provide that the radial width of the annular channel be smaller than the radial extension of the wall elements of the valve rotor, and the mean radius of the channel be at least approximately equal to the mean radius of the wall elements.

It has proved also advantageous to design the supply channels terminating radially in the annular channel with a cross-section which is flat in in the axial direction and extended in the circumferential direction.

In another embodiment of the massage shower head, equipped with a valve rotor and having a closing disk in the shape of a semicircular ring segment, bore field segments are provided having at least approximately the radial width of the ring segment of the closing disk and limited, at their inside turned to the head, by a front face which slopes away from the plane of rotation, obliquely in a straight line, or arcuately. With a massage shower head of such design it is possible to mount the valve rotor, known per se (U.S. Pat. No. 3,801,019) without a centric guide pin for free rotation in the space where it is accommodated and to ensure, in spite of that, that the closing disk and the nozzle plate or bore field segments can contact each other only along a line and never along a surface, and that during its rotary motion the valve rotor can execute also axial tumbling movements which result in a perceptibly more pronounced pulsating effect.

It is also useful, with water conveying channels extending radially obliquely in the plane of rotation of the valve rotor, to provide the valve rotor, at the top side of the closing disk designed as a semicircular ring segment disk, with wall elements which extend parallel to the radial limiting edges of the closing disk, and to provide the wall elements adjacent the limiting edges with perpendicularly projecting tongues.

While all known valve rotors of such massage shower heads are designed, at least approximately, symmetrically with respect to their center, thus without imbalance, the intentionally unsymmetrical, out-of-balance shape of the inventive valve rotor produces an unexpected increase in the effect of pulsation and, at the same time, is more reliable in operation with respect to the automatic start of the valve rotor even at lower rates of flow or hydraulic pressures.

Accordingly it is an object of the invention to provide a pulsating water jet massage shower head which produces pulsing water jets by means of a valve rotor which is mounted for free rotation and axial play above a nozzle plate which has a plurality of jet forming nozzle bores and which valve member is provided with a plurality of radial wall elements as well as a segmental closing disk and which includes water conveying channels upstream of the rotor which produce a rotary water motion in the space accommodating the rotor and wherein hollow cylindrical pin portions which define bore forming extensions of the nozzle bores through the bottom of the nozzle member extend into a pressure cavity defined between the nozzle member and the valve member which project approximately to the plane of rotation of the closing disk portion of the valve member.

A further object of the invention is to provide a pulsating water jet shower head which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings:

FIG. 5;

GENERAL DESCRIPTION OF THE PREFERRED EMBODIMENTS

Figure 4:
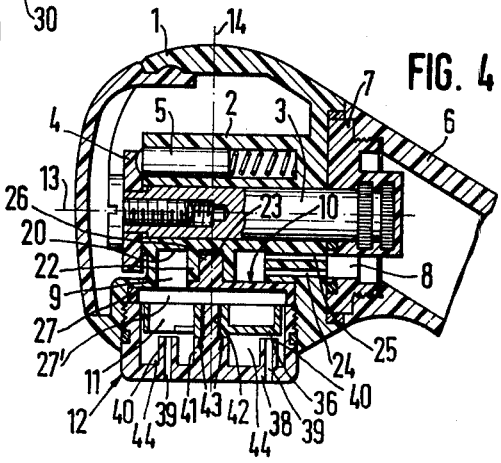
FIG. 4 is a sectional view taken along the line C—C of FIG. 1, with the additional parts of FIG. 1 added.

Referring to the drawing in particular the invention embodied therein in FIGS. 1 to 4 comprises a shower head or shower head housing 1. In order to show the advantageous possibility of a very rugged construction, the device for producing pulsating water jets is shown, in the present example, in application to a shower head 1 of a hand spray, which is mounted for rotation on a cylindrical pivot pin 3 and can be fixed in three different positions by means of a snap mechanism comprising a locking disk 4 and a plunger pin 5. On its periphery, in a plane perpendicular to the axis of pivot pin 3, shower head 1 is provided with two further spray nozzles having different characteristics (not shown). As shown in FIG. 4, pivot pin 3 is secured to a disk 7 which is fixed to the front end of a handle part 6 (shown only partly).

Disk 7 is provided with an axial aperture 8 to which, in the respective snap positions of shower head 1, the connecting channels to the individual spray nozzles are connected.

The device for producing pulsating water jets comprises substantially an annular channel 9 which is provided in the hub 2 of shower head 1, with a cover disk 10, a valve rotor 11, and a cup-shaped nozzle body 12. All these parts are mounted concentrically of an axis 14 which is perpendicular to the axis of rotation 13 of shower head 1. At the same time, axis 14 is the axis of symmetry of a cylindrical blind bore 15 in the bottom of which annular channel 9 is provided. Blind bore 15 is provided with an internal thread 16 into which cylindrical portion 18 of nozzle body 12 which is provided with a fitting external thread 17, can be screwed. Annular channel 9 has a rectangular cross-section (see FIG. 2) and extends through an angle gamma ($\alpha$) of about 355°. Its starting end is formed by a radial wall surface 19 extending parallel to axis 14. The annular bottom 20 of channel 9 is planar, but provided, in the zone of its other end, with a guide surface 21 extending through an angle beta ($\beta$) of about 90° and with an inclination of about 45°. The center around which annular channel 9 extends is formed by a cylindrical hub 22 which is provided with an axial blind bore 23. Close to wall surface 19, two axially juxtaposed supply channels 24, 25 having each a cross-section which is flat in the axial direction and elongated in the circumferential direction, terminate in annular channel 9. In the angular position of shower head 1 shown in FIG. 4, channels 24, 25 communicate with aperture 8 of disk 7.

Figure 1:
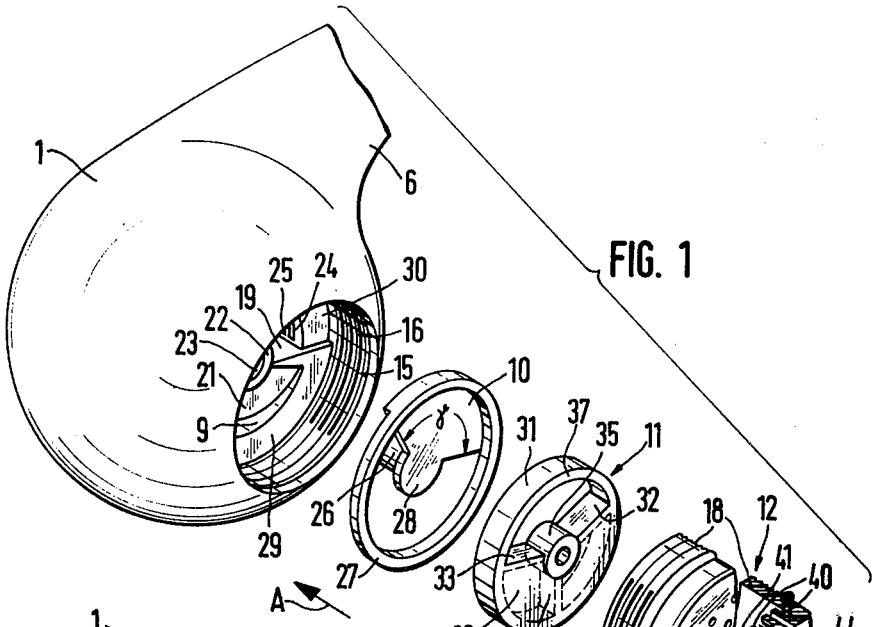
FIG. 1 is a perspective, exploded view of a massage shower head for producing pulsating water jets, and the individual parts thereof.
Figure 2:
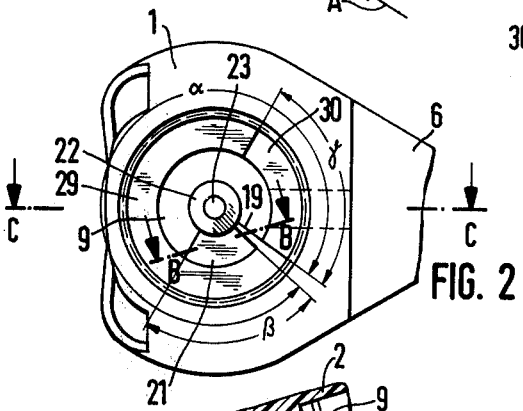
FIG. 2 is a front end view of the shower head in the direction A of FIG. 1.
Figure 3:
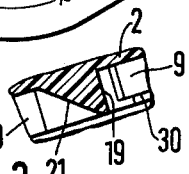
FIG. 3 is a partial sectional view taken along the line B—B of FIG. 2.

Cover disk 10 has the form of a sector of a circle extending through an angle gamma of about 90° and provided with a centric pin 26 fitting into blind bore 23 of hub 22, and equipped with a concentric spacer ring 27 having an outside diameter corresponding to the inside diameter of blind bore 15 of shower head 1. As shown in FIGS. 1 and 4, pin 26 of cover disk 10 projects from a tongue-like central portion 28 of cover disk 10 the outline of which corresponds to the circumference of hub 22 of annular channel 9. Cover disk 10 is integral with pin 26 and spacer ring 27 and axially formed to the latter. In order to permit the positioning of cover disk 10 in contact with annular shoulder 29 surrounding annular channel 9, shoulder 29 is provided with a recess 30 corresponding to the thickness of cover disk 10 and also extending through the angle gamma. To the same end, hub 22 is shorter than the total depth of the remaining portion of annular channel 9, by the thickness of cover disk 10.

Valve rotor 11 comprises an outer ring 31, three radial wall elements 32, 33 and 34, a hub 35, and a bottom 36 forming the closing disk and extending from wall element 32 over wall element 34 to wall element 33, Valve rotor 11 again is a plastic part injection-molded in one piece. Bottom 36 extends between wall elements 32, 33 and 34, so that its underside visible in FIG. 1 extends in the same plane as lower front surface 37 of ring 31. Hub 35 is formed so as to project from the lower plane of bottom 36 by approximately 0.2 mm. The outer diameter of ring 31 is smaller than the inner diameter of spacer ring 27 of cover disk 10 and as for the rest, dimensioned so that valve rotor 11 can be received in the cylindrical portion 18 of nozzle body 12 with a small radial play.

The thin-walled bottom 38 of nozzle body 12 is provided with a plurality of nozzle bores 39 which extend in parallel to axis 14 and, as shown in FIG. 1, are arranged in three groups of equal extension which are spaced from each other at equal mean angular distances and extend beyond the thickness of bottom 38 by means of nozzle bore portions or hollow pins 40 projecting to the inside. In the center of bottom 38, an inwardly projecting cylindrical extension 41 is provided terminating in a journal pin 42 and possessing a shoulder 43 which extends in the same plane as the ends of hollow pins 40 (see FIG. 4).

In assembled state, the described parts occupy the positions shown in FIG. 4. Pin 26 of cover disk 10 is slightly press-fitted in blind bore 23 of hub 22 of annular channel 9, and cover disk 10 covers the starting end of annular channel 9 which, otherwise, at its outlet end, is open. Spacer ring 27 rests against annular shoulder 29 surrounding annular channel 9 and forms a thin circular hollow space 27'. Hub 35 of valve rotor 11 is received on journal pin 42 of nozzle body 12 which is screwed in up to spacer ring 27. It may be evident that bottom 36 of valve rotor 11 forming the closing disk, due to the extended length of hub 35, is spaced from the ends of hollow pins 40 including nozzle bores 39 by a distance corresponding to the previously mentioned length in excess of hub 35, and that a pressure cavity 44 is formed between the plane of rotation of bottom 36 of valve rotor 11 and the inside surface of bottom or nozzle plate 38, and that hollow pins 40 project into this cavity 44. Further, valve rotor 11 is mounted for free axial motion toward and away from annular channel 9.

It may also be noted that the entire device for producing pulsating water jets comprises merely three separate parts, the annular channel being a part of the shower head or housing 1, and that these parts can be accommodated, very ruggedly, in a relatively small space. In addition, it may be learned from FIG. 4 that the width of annular channel 9 is smaller by about one third than the radial length of wall elements 32, 33, 34 of valve rotor 11, and that the mean radius of annular channel 9 corresponds, at least approximately, to the mean radius of wall elements 32, 33, 34. Due to this design, a particularly favorable drive effect of the water to which a rotary motion is imparted by annular channel 9, on valve rotor 11 is obtained. In addition, due to the back pressure produced in pressure cavity 44 and counteracting the main flow in axial directions, valve rotor 11 is held in its plane of rotation in a substantially floating position, so that only extremely small bearing friction can occur on journal pin 42 and annular shoulder 43.

Figures 5, 6, 7, 8, 9, 10, 11, 12:
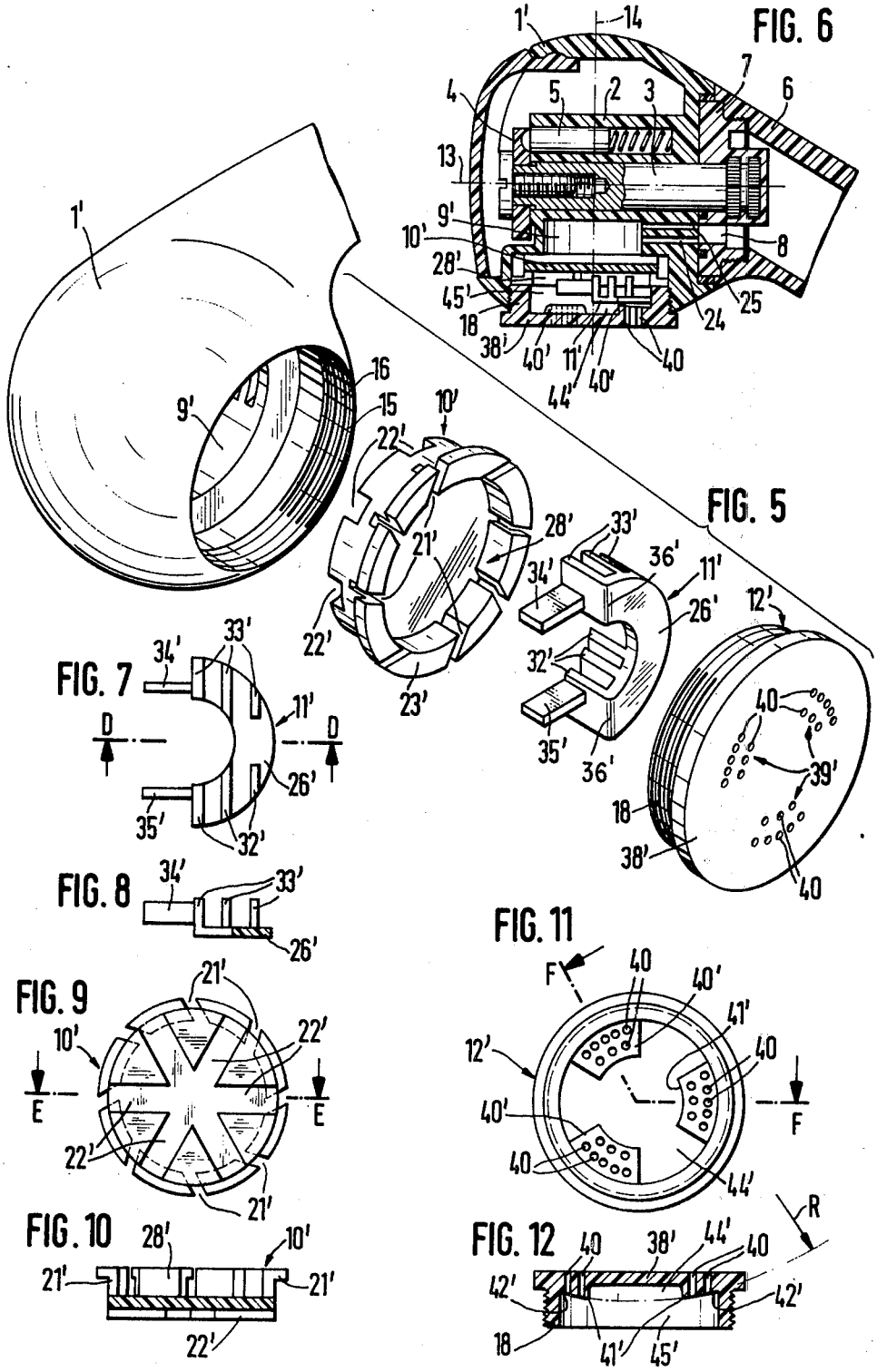
FIG. 5 is a view similar to FIG. 1, of another embodiment of the massage shower head.
FIG. 6 is a sectional view of the shower head shown in FIG. 5.
FIG. 7 is a top plan view of the valve rotor.
FIG. 8 is a sectional view of the valve rotor taken along the line D—D of FIG. 7.
FIG. 9 is a top plan view of the water conveying body.
FIG. 10 is a sectional view of the water conveying body, taken along the line E—E of FIG. 9.
FIG. 11 is a top plan view of the nozzle plate.
FIG. 12 is a sectional view of the nozzle plate, taken along the line F—F of FIG. 11.

A shower head assembly 1' shown in FIGS. 5 and 6 is another embodiment of the device for producing pulsating water jets. All other parts of the shower head 1', including handle 6, are of the same design as in shower head 1 and, therefore, designated with the same reference numerals. In the end housing of the shower head 1', supply channels 24 and 25 terminate in a cylindrical cavity 9' which does not comprise any hub and, therefore, is not designed as an annular channel. As a water conveying body, instead of cover disk 10, a hollow cylindrical body 10' is provided having distributing grooves 22' which are formed on the front surface of body 10' facing cavity 9' and extend star-like radially outwardly, and further having a plurality of obliquely radially extending water conveying channels 21'. The cylindrical border 23 forms a cylindrical cavity 28' into which the water is directed through channels 21'.

Valve rotor 11' comprises a semicircular closing disk portion or ring segment disk 26' which is provided, on its upper side, with wall elements 32' and 33' extending in parallel to the radial limiting edges 36'. Wall elements 32' and 33' carry radial edges 36', with tongues 34' and 35' which project perpendicularly therefrom. Nozzle body 12' comprises a hollow cylindrical body having a cylindrical threaded portion 18 which can be screwed into the internal thread 16 of shower head 1', and a bottom or nozzle plate 38' in which segment-shaped bore fields 39' are arranged which are angularly equidistantly spaced from each other. Each bore field 39 comprises a plurality of jet bores 40. On the inside of nozzle plate 38', elevations or nozzle bore portions 40' of ring-segmental shape are provided in which the jet bores 40 extend and the front faces of which form each a circular or spherical surface sloping radially outwardly, with a radius R (FIG. 12) such that the axial difference in height between the inner higher border 41' and the outer border 42' is approximately 0.5 mm. Again, as in the embodiment of FIGS. 1 to 4, a pressure cavity 44' is formed between the segmental elevations 40', which cavity is slightly shallower than cavity 44 of the first embodiment.

The diameter of cylindrical cavity 45' provided in cylindrical portion 18 of nozzle body 12' is, at least approximately, equal to the inside diameter of cavity 28' of water conveying body 10'. At the same time, valve rotor 11' is dimensioned so as to be able with an axial play and only a very small radial play, to rotate in the assembled cavities 28' and 45' freely and while executing axial motions. It may clearly be learned from the drawing, particularly from FIGS. 5 and 7, that the shape of valve rotor 11' is very unsymmetrical but, surprisingly, the rotor is capable of producing pulsation effects which are substantially more pronounced than in the more or less symmetrical valve rotors of the prior art.

While specific embodiments of the invention have been shown and described in detail to illustrate the application of the principles of the invention, it will be understood that the invention may be embodied otherwise without departing from such principles.

What is claimed is:

1. A massage shower head comprising a housing having a water chamber therein, a mechanism in said water chamber for producing pulsating water jets including a nozzle plate enclosing said water chamber, a valve rotor which is mounted in said water chamber for free rotation and axial play directly above said nozzle plate, said nozzle plate having a bottom with an interior surface, a plurality of nozzle bore portions extending inwardly toward said valve rotor from said interior surface of said nozzle plate bottom each having at least one jet forming nozzle bore therethrough and through said bottom, said valve rotor being provided with at least one radial wall element as well as with a segmental closing disk portion, water conveying channel means connected into said water chamber directed so as to produce a rotary water motion in said water chamber in the space accommodating said rotor, said water chamber having a pressure cavity between the plane of rotation of said closing disk portion of said valve rotor and said nozzle plate which is open toward said nozzle plate, said jet forming nozzle bore projecting into approximately the plane of rotation of said closing disk, whereby a water cushion is formed between said rotor and said nozzle bore portions by water flowing into said pressure cavity.

2. A massage shower head according to claim 1, wherein said nozzle plate includes a central journal pin having an annular shoulder extending inwardly from the interior surface of said bottom, said valve rotor being rotatably guided on said journal and said shoulder.

3. A massage shower head according to claim 1, wherein said valve rotor includes three radial wall elements angularly equidistantly spaced from each other, a ring wall surrounding said wall elements and having axial lengths approximately equal to the axial length of said wall elements, said closing disk extending over the areas between at least two adjacent radial wall elements.

4. A massage shower head according to claim 1, wherein said housing includes an annular channel, a cylindrical pin member defined in said housing within said channel coaxial of the axis of rotation of said rotor, said water conveying channel means including the supply channel terminating in said annular channel, said annular channel having a bottom which extends at least partly obliquely relative to the axis of symmetry toward the plane of rotation of said valve rotor.

5. A massage shower head according to claim 4, wherein the radial width of said channel is smaller than the radial extension of said wall element of said valve rotor and wherein said annular channel and said wall elements have mean radii which are approximately equal.

6. A massage shower head according to claim 5, wherein said supply channel terminates in an annular channel which has a cross-section which is flat in the axial direction and wide in the circumferential direction.

7. A massage shower head according to claim 6, wherein said annular channel begins in a zone where the supply channel terminates therein and extends to an angle of approximately 357° up to an end zone in which the bottom of said channel is provided with a guide surface, said guide surface being provided on said bottom and having an inclination of about 45° relative to the plane of rotation of said valve rotor.

8. A massage shower head according to claim 1, wherein said housing includes a cylindrical blind bore having an annular channel defined at the interior thereof, a segmental shaped disk cover covering said channel, said cover having an annular spacer ring therearound, said nozzle plate including a bottom wall, and an annular wall threaded into said housing and being adjustably threadably positioned in order to vary the pressure space.

9. A shower head according to claim 8, wherein said cover disk includes a pin portion, said housing having a central bore into which said pin portion projects, said pin forming an inner limiting surface of said annular channel.

10. A shower head according to claim 9, wherein said cover disk extends through a sector angle of about 90°.

11. A shower head according to claim 1, wherein said nozzle plate has bores arranged in three groups which are distributed over the inner annular surface of said nozzle plate at equal mean angular distances on three nozzle bore portions.

12. A shower head according to claim 1, wherein said water conveying channel means comprises at least one water channel extending radially obliquely in respect to the plane of rotation of said valve rotor, said valve rotor comprising wall elements which are formed on the upper side of a closing disk which comprises a semicircular ring segment, said ring segment defining radial limiting edges around the closing disk provided with tongues which project perpendicularly therefrom.

13. A shower head according to claim 1, including a valve rotor comprising a closing disk of the shape of a semi-circular ring segment, said nozzle bore portions comprising bore field segments of a width approximately equal to the radial width of said ring segment of the closing disks, each bore field segment being limited by a front face adjacent said valve rotor which slopes obliquely from the plane of rotation of said closing disk.

14. A pulsating water jet massage shower head, comprising a shower head housing having an interior chamber opened at one end, a nozzle member closing the one end of said housing chamber and having a bottom with an interior and exterior surface, said bottom including a plurality of nozzle bore portions extending inwardly from said interior surface with at least one nozzle bore through each of said nozzle bore portions forming spray nozzle discharges through said bottom, a cover member in said housing member spaced inwardly from said nozzle bore portions, a valve rotor rotatably positioned between said cover member and said nozzle bore portions and being free for axial movement therebetween and having a plurality of radial wall portions and a closing disk portion, a portion of said housing chamber between said valve rotor and said nozzle bottom defining a pressure cavity, water conveying channel means defined in said housing for conveying a water stream upstream of said cover member into said pressure cavity, said cover member and the manner in which the water is conveyed by said conveying channel producing pulsating water jets through said nozzle bores, said nozzle bores through said nozzle bore portion of said bottom extending up to approximately the plane of rotation of said valve rotor closing disk portion, said valve rotor being floatable in rotary motion in said water stream whereby a water cushion is formed by the water stream between said valve rotor and said nozzle member.

15. A pulsating water jet massage shower head according to claim 14, wherein said shower head housing includes a handle portion, a head portion rotatable in respect to said handle portion, said head portion carrying said nozzle member, and detent means for anchoring said head portion relative to said handle portion at a selected position.

16. A pulsating water jet massage shower head according to claim 14, wherein said nozzle bore portions comprise a plurality of hollow cylindrical pin portions extending inwardly from the interior surface of said bottom defining the bores forming the spray nozzle discharge.

17. A massage shower head according to claim 14, wherein the bores forming the spray nozzle discharges are located in groups distributed around said nozzle plate, the interior surface of said nozzle bore portions being sloped inwardly toward said valve rotor into the pressure chamber from the periphery toward the center thereof.

18. A pulsating water jet massage shower head according to claim 14, wherein said housing includes an interior portion defining the cover member receiving bore, said cover member having a hub portion engageable in said bore, said cover member including a flat disk portion around said hub portion and an annular ring portion connected to the periphery of said disk portion, said valve rotor including radially extending ribs comprising said radial wall portions, said closing disk portion extending between some of said ribs and leaving at least one segmental portion open.

* * * * *